US006564786B2

(12) United States Patent
Kameda et al.

(10) Patent No.: US 6,564,786 B2
(45) Date of Patent: May 20, 2003

(54) APPARATUS AND METHOD FOR CONTROLLING IGNITION OF AN INTERNAL COMBUSTION ENGINE

(75) Inventors: Hiroyuki Kameda, Nagoya (JP); Yoshihiro Matsubara, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 58 days.

(21) Appl. No.: 09/968,713

(22) Filed: Oct. 2, 2001

(65) Prior Publication Data

US 2002/0043255 A1 Apr. 18, 2002

(30) Foreign Application Priority Data

Oct. 3, 2000 (JP) ..... 2000-303057

(51) Int. Cl.[7] ..... F02P 3/00; F02P 9/00

(52) U.S. Cl. ..... 123/606; 123/625; 123/644; 123/650

(58) Field of Search ..... 123/606, 644, 123/649, 650, 653, 654, 625, 626, 609, 655, 656, 630; 324/379, 388; 361/263

(56) References Cited

U.S. PATENT DOCUMENTS 5,269,282 A * 12/1993 Miyata et al. ..... 123/627

FOREIGN PATENT DOCUMENTS

| | | | | |
|---|---|---|---|---|
| JP | 85250 | * | 5/1985 | ..... F02P/3/00 |
| JP | 318284 | * | 11/1992 | ..... F02P/11/04 |
| JP | 41138 | * | 2/2001 | ..... F02P/17/00 |

* cited by examiner

*Primary Examiner*—Hieu T. Vo
*Assistant Examiner*—Hai H. Huynh
(74) *Attorney, Agent, or Firm*—Morgan, Lewis & Bockius LLP

(57) ABSTRACT

In the ignition apparatus for internal combustion engine according to the invention, during a period when spark discharge voltage is detected by a waveform detecting unit 20 and an ignition coil 12 supplies the spark discharge voltage by use of ignition detection 22, ignition in each of cylinders is detected in accordance with discharged voltage by the waveform detecting unit 20. When the ignition detection 22 detects the ignition by use of, for example, an ignition control unit 24, during a discharging period of supplying the spark discharge voltage having detected the ignition, the supply of the spark discharge voltage is stopped. Thereby, since the supply of the spark discharge voltage is stopped after having detected the ignition, it is possible to avoid the surplus supply of spark energy to the spark plug 10 after having fired.

10 Claims, 6 Drawing Sheets

APPARATUS AND METHOD FOR CONTROLLING IGNITION OF AN INTERNAL COMBUSTION ENGINE

BACKGROUND OF THE INVENTION

1. Field of the Invention

The present invention relates to an ignition apparatus and a method for igniting an internal combustion engine. In particular, the present invention and method are particularly useful in an in-cylinder direct gasoline engine, a gas engine with an accessory cell, and others.

2. Description of the Related Art

Combustion embodiments of recently practiced in-cylinder direct gasoline engines include a uniform premixed air-fuel mixture combustion with fuel injection during inlet strokes of a piston and a stratified combustion with fuel injection during compression strokes.

In the stratified combustion, it is important to send an air-fuel mixture, which is most suitable to ignite, on the periphery of spark plugs. It is known that the time from a firing of a spark plug to a fuel ignition as a start of combustion has dispersions depending on driving conditions (for example, a fuel injection timing, a valve opening-closing timing, flowing of an air-fuel mixture in a cylinder). It is described in a following explanation that a fuel ignition as a start of combustion is the ignition, and that a firing of a spark plug is the firing.

Therefore, if the duration of an inductive current, which is induced by an ignition coil at discharging spark, is determined to be longer than that of the uniform premixed air-fuel mixture combustion, it certainly makes an ignition possible and the combustion is always stable, whereby the stratified combustion is available in response to any driving condition.

However, if the spark discharge time is determined to be longer as mentioned above for obtaining the secure ignition under unstable conditions, the inductive current necessary to the spark discharge is given to the spark plugs for a certain time, irrespective of driving conditions. In certain-driving conditions, the inductive current is continuously supplied between electrode gaps of the spark plug after the ignition, whereby to accelerate an electrode wear of the spark plug by excessive spark energy and to probably shorten a life cycle of the spark plug.

SUMMARY OF THE INVENTION

It is an object to the invention to offer an ignition apparatus for internal combustion engine and a method capable of improving the life cycle of the spark plugs without spoiling the ignition capacity of the internal combustion engine.

In order to achieve the above object, an ignition apparatus for an internal combustion engine of the invention, is equipped with:

at least one spark plug operable to ignite a fuel mixture in at least one cylinder of an internal combustion engine;

an ignition coil including at least one primary coil and at least one secondary coil operable to generate a spark discharge voltage to be supplied to the at least one spark plug;

a spark discharge voltage detecting unit operable to detect the spark discharge voltage;

an ignition detecting unit operable to detect an ignition in the at least one cylinder during a period when the ignition coil supplies the spark discharge voltage;

a first ignition control unit operable to control a current supplied to the at least one primary coil for generating the spark discharge voltage in the at least one secondary coil; and a second ignition control unit operable to control the current supplied to the at least one primary coil to stop the supply of the spark discharge voltage in the at least one secondary coil, wherein said second ignition control unit stops the supply of the spark discharge voltage in the at least one secondary coil based on the detected ignition during the period when the ignition coil supplies the spark discharge voltage.

The ignition apparatus for an internal combustion according to another embodiment of the present invention may include a driving condition discriminating unit that may determine operating conditions of the internal combustion engine and supply the determined operating conditions to the ignition control unit, the spark discharge voltage detecting unit, and the ignition detecting unit. The operating conditions may include, for example, and air-fuel mixture, a lean condition, or layer air-intake conditions.

Another embodiment of the present invention may include a feature wherein the ignition detecting unit detects the ignition in the cylinder based on a predetermined high frequency component included in the spark discharge voltage. Further, the present invention allows for stopping the supply of the spark discharge voltage by providing current to the one primary coil.

In yet another embodiment of the present invention, the first ignition control unit is operable to control the supply of current to the at least one primary coil to generate the spark discharge voltage in the at least one secondary coil, and the second ignition control unit operable to interrupt the supply of the current to the at least one primary coil.

Also, the present invention allows for repeatedly supplying and interrupting the supply of the current to the at least one primary coil by the first and second ignition control units.

Further, the spark discharge voltage detecting unit of the present invention may include a coupling capacitor used in conjunction with the primary and secondary coils.

A method for controlling ignition in an internal combustion engine according to the present invention may include the steps of:

controlling a current supplied to a primary coil of an ignition coil for generating and stopping a spark discharge voltage in a secondary coil of the ignition coil;

supplying the spark discharge voltage from the ignition coil to an spark plug;

detecting the supplied spark discharge voltage;

detecting an ignition in at least one cylinder of the combustion engine in accordance with the detected spark discharge voltage during a period when the ignition coil supplies the spark discharge voltage; and stopping the supply of the spark discharge voltage based on the detected ignition.

In a further step, the ignition may be detected based on a predetermined high frequency component included in the spark discharge voltage. In addition, the supply of the spark discharge voltage may be stopped by providing the current to the primary coil.

Therefore, according to the aforementioned embodiments, in a first aspect of the invention, for the period when the spark discharge voltage is detected by the spark discharge voltage detecting unit and when the ignition coil supplies the spark discharge voltage by the ignition detecting unit, the ignition of each cylinder is detected in accordance with the detected voltage by the spark discharge voltage detecting means when the ignition detecting unit detects the ignition by the second ignition control unit, the supply of the spark discharge voltage is stopped for the discharging period when supplying the spark discharge voltage which indicates to detect the ignition. Thereby, the ignition is detected and the supply of the spark energy is stopped, so that it is possible to prevent the supply of the excessive spark energy to the spark plug after the ignition.

Incidentally, the purpose of detecting the ignition is to detect misfires concurrently. But a detailed investigation is actually necessary for each of engines to determine a threshold value for judging the ignition or the misfire if detecting the ignition from the spark discharge voltage, and trying to judge the ignition or the misfire by a predetermined threshold value, even if it is actually the misfire, there happens 10 to 20% of the whole cases that waveforms of the spark discharge voltage indicate the ignitions owing to variations of engine characteristics or variances in environmental conditions. But, as the invention has a purpose of steadily detecting the ignition, it is not necessary to set the threshold value in such a boundary area (gray zone) where the ignition or the misfire is not always clear ordinarily, or where a judgment depends on the environmental conditions. But it is sufficient to set the threshold value for ignition detection in the boundary between the gray zone and an area (white zone) where the ignition can be certainly judged. In this case, when the waveform of the spark discharge voltage cannot distinctly judge the misfire or the ignition, the spark discharge is continued without interruption, even though it is actually the ignition. But this is a slight influence in another object of the invention reducing consumption of the plug, since 10 to 20% of the whole cases that the spark discharge is continued without interruption. It is possible thereby to avoid an error of interrupting the spark discharge by an error detection of the ignition in spite of the misfire. In the present invention, it is important for the present invention not to set the threshold value in the gray zone.

In a second aspect of the present invention, when the driving condition of the internal combustion engine is discriminated as, for example, a lean or layer air-intake condition by means of the driving condition is criminating means for discriminating driving conditions of the internal combustion engine, the control is carried out through the spark discharge voltage detecting unit, the ignition detecting unit and the second ignition control unit. Thereby, under the driving condition of lean or layer air-intake where the supply time of the spark discharge voltage by the ignition coil is longer than that of the uniform air-fuel premixture, it is possible to prevent the supply of the excessive spark energy to the spark plug after the ignition.

In a third aspect, the detection of ignition by the ignition detecting unit may be performed by detecting predetermined high frequency components included in the spark discharge voltage. Thereby, it is possible to detect the high frequency oscillation of the discharged voltage caused by disturbing a discharged spark of the spark plug through the good combustion after ignition, so that the ignition detection can be easily done.

In a fourth aspect, the stoppage of supply of the spark discharge voltage by the second ignition control unit is performed by re-supplying a primary current of the ignition coil to the primary coil. Thereby, in the secondary coil of the ignition coil, an inductive current is generated in a reversal direction to the already generating inductive current, so that it is possible to restrain an occurrence of the spark discharge voltage by the ignition coil.

In a fifth aspect, control maybe carried out for repeatedly plural times generating the spark discharge voltage to the ignition coil by means of the first ignition control unit, and the control for the repeating generations by the first ignition control unit is interrupted by means of the second ignition control unit. Thereby, the interrupting control by the second ignition control unit is performed for the first ignition control unit, so that it is possible to easily embody the stoppage of supply of the spark discharge voltage by the second ignition control unit.

In a sixth aspect, the ignition coil comprises plural coils which are provided with the ignition control unit of a plurality of coils supplying in succession and separately the spark discharge voltage in substitution for the first ignition control unit, and the stoppage of supply of the spark discharge voltage by the second ignition control unit is performed by the interruption of successive supply of the spark discharge voltage by the ignition control unit of the plural coils. Thereby, the interrupting control is performed by the second ignition control for the ignition control unit of the plural coils, so that it is possible to easily embody the stoppage of the spark discharge voltage by the second ignition control unit.

In a seventh aspect, in the ignition apparatus for internal combustion engine, the stoppage of supply of the spark discharge voltage by the second ignition control unit is performed together with re-supply of the primary current to the primary coil of the ignition coil. Thereby, although during the period of repeating supply of the spark discharge voltage by the first ignition control unit in the first ignition control unit, or during the period of supplying the spark discharge voltage by the coil in the plural coil ignition control unit, an inductive current is generated in a reversal direction to the already generating inductive current in the ignition coil or in the secondary coil of the coil, so that it is possible to restrain occurrence of the spark discharge voltage by the ignition coil et al.

In an eighth aspect, the spark discharge voltage detecting unit may be equipped with a coupling capacitor for a primary circuit of the ignition coil or a secondary coil circuit of the ignition coil. By means of such a comparatively simple circuit composition of connecting a capacitor in series to the primary coil circuit or the secondary coil circuit, it is possible to take out an objective predetermined high frequency components, while removing direct current components.

DESCRIPTION OF THE PREFERRED EMBODIMENTS

Explanation will be made to the embodiment of the ignition apparatus for internal combustion engine of the invention with reference to each attached drawing.

Figure 1A:
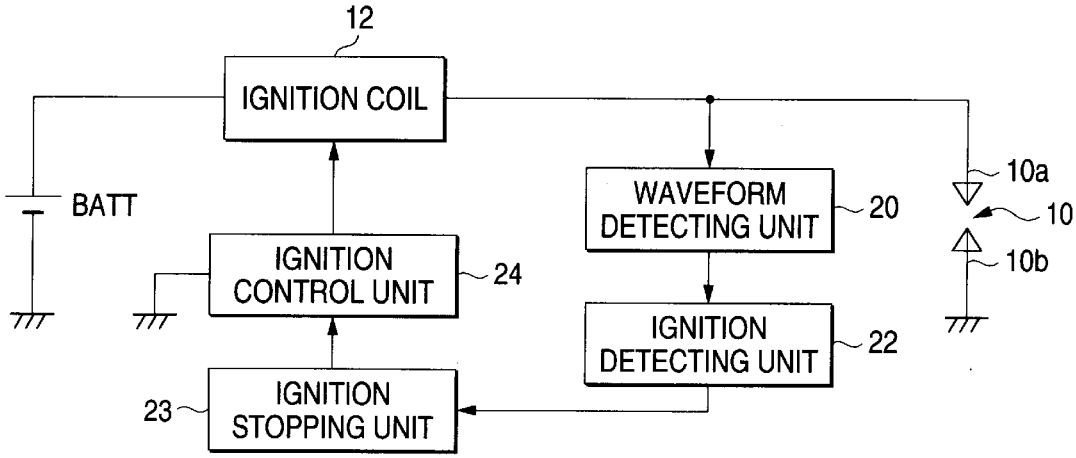
FIG. 1A is a block diagram showing the composition of the ignition apparatus for internal combustion engine relating to the embodiment of the invention.

As shown in FIG. 1A, the ignition apparatus for internal combustion engine according to the present embodiment mainly comprises the spark plug 10, the ignition coil 12, waveform detecting unit 20, the ignition detecting unit 22, the ignition stopping unit 23, and the ignition control unit 24.

The spark plug 10 has a center electrode 10*a* and an ground electrode 10*b*. Both electrodes are furnished to the Internal combustion engine so that they are exposed in the cylinders of the internal combustion engine. When the spark discharge voltage supplied from the ignition coil 12 is impressed to the center electrode 10*a* and the ground electrode 10*b*, the spark discharge is made-between both electrodes.

The secondary coil 12 comprises that the primary coil and the secondary coil are coiled around, e.g., a magnetic core. The coiling ratio of both coils are set to be a predetermined value.

The primary coil is connected at one side with a plus terminal of a battery BATT and at the other side with a minus terminal of the battery BATT via a switching element composing the ignition control unit 24. On the other hand, the secondary coil of the ignition coil 12 is connected at one side with the center terminal 10*a* of the spark plug 10 and at the other side with the ground electrode 10*b* via an earth.

Being composed as above, when ON/OFF of the switching element is controlled by the ignition control unit 24, spark discharge voltage is generated in the secondary coil of the ignition coil 12. It applies the electricity to generate spark discharge voltage in the secondary coil of the ignition coil 12, if the switching element is a state of "ON". It cuts off the electricity not to generate spark discharge voltage in the secondary coil of the ignition coil 12, if the switching element is a state of "OFF". A high voltage in response to the coiling ratio of the ignition coil 12 is the discharge voltage which is generated in the secondary coil of the ignition coil 12. The spark discharge voltage is thereby supplied from the ignition coil 12 to the spark plug 10, and a spark discharge can occur between the center electrode 10*a* and the ground electrode 10*b* of the spark plug 10.

Figure 1B:
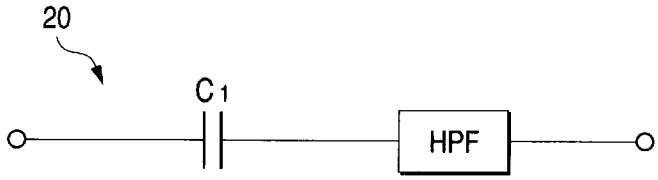
FIG. 1B is a circuit showing one embodied example of the waveform detecting unit composing the ignition apparatus for internal combustion engine.

As shown in FIG. 1B, the waveform detecting unit 20 comprises, for example, a capacitor C1 and a high pass filter (called as "HPF" hereafter). The capacitor C1 is placed before HPF, and connected in series to the primary coil circuit or the secondary coil circuit of the ignition coil 12. In short, the capacitor C1 functions as a coupling capacitor for the primary coil circuit or the secondary coil circuit of the ignition coil 12, so that it takes out the alternating current components as removing direct current components. And the capacitor C1 outputs the obtained alternating current components (high frequency components) to a rear HPF. Thereby, it is possible to detect the voltage waveforms of the spark plug at spark discharging through the comparative simple circuit.

Figure 2A:
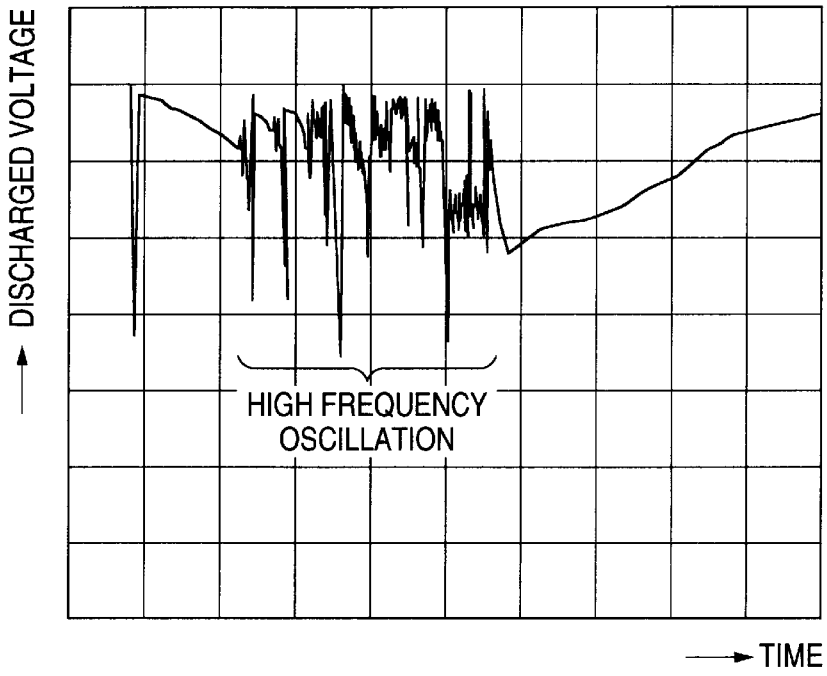
FIG. 2A is a waveform showing the components of the high frequency occurring in the discharged voltage at the stratified combustion.
Figure 2B:
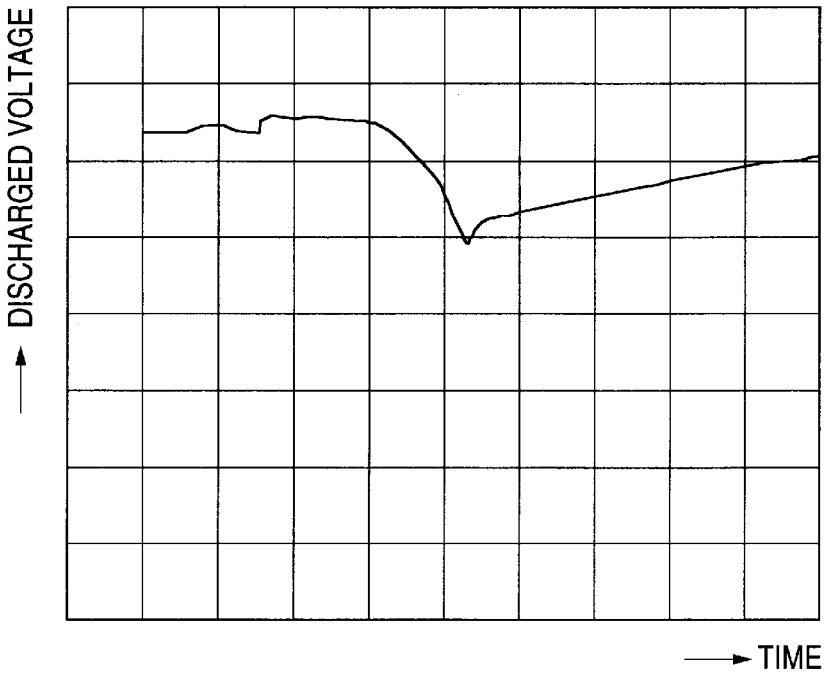
FIG. 2B is a waveform showing the discharge voltage at the non-stratified combustion.

HPF is a filter to pass components of the higher frequency than the predetermined frequency. The HPF comprises e.g., a capacitor, an inductor or a resister. In the case of the present embodiment, the predetermined frequency is set to allow the pass of the frequency components of e.g., 50 kHz or higher. As seen in FIG. 2A, the predetermined frequency is set for detecting the high frequency components of discharged voltage immediately after ignition in the stratified combustion. The high frequency oscillation of the discharged voltage as shown in FIG. 2A are caused by disturbing a discharged spark of the spark plug through the good combustion. As seen from the waveform shown in FIG. 2B, the high frequency oscillation scarcely occurs in the discharged voltage at non-stratified combustion of e.g. uniform premixed air-fuel mixture. Accordingly, by detecting the predetermined high frequency components (for example, the high frequency components of 50 kHz or higher) included in the spark discharge voltage, the ignition can be easily detected.

The ignition detecting unit 22 comprises a microcomputer and a predetermined control program. And when it is satisfied desired conditions, it detects the ignition and outputs ignition information. As the microcomputer, used may be an engine control unit (called as "ECU" hereafter) governing general controls of respective electronic parts relative with the internal combustion engine.

The predetermined conditions by the ignition detecting unit 22 implies that the voltage waveform including the high frequency components of 50 kHz or higher is detected by the waveform detecting unit 20 detecting 5 times or more for a period of 0.1 msec. Actually, input signals from the ignition detecting unit 22 connected to a determined input port are detected by a process of timer interruption implementing in an order of e.g., microsecond. When the voltage waveform including the high frequency components of 50 kHz or higher is detected 5 times or more within this period of 0.1 mSec by the ignition detecting unit 22, the ignition is detected to output the ignition information to the ignition control unit 24.

Figure 1C:
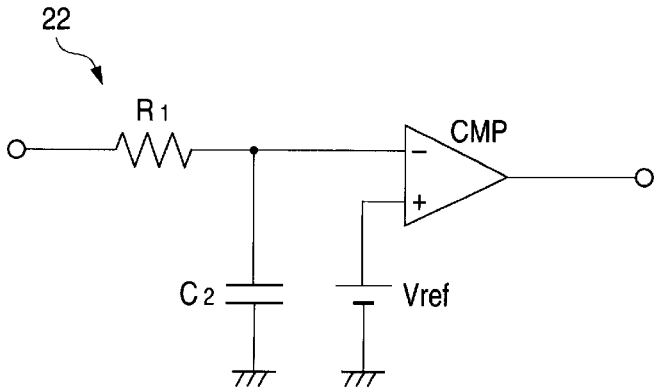
FIG. 1C is a circuit showing one embodied example of the ignition detecting unit composing the ignition apparatus for internal combustion engine

Further, the ignition detecting unit 22 may be also realized by hardware as shown in FIG. 1C. The ignition detecting unit 22 comprises, e.g., a capacitor C2, CR integrator circuit by a resister R1, and a comparator CMP.

Namely, the resister R1 is connected in series to the output terminal of the waveform detecting unit 20, and the capacitor C2 is connected in parallel between the earth and a terminal opposite to the waveform detecting unit 20 of the resister R1.

On the other hand, an inverted input terminal of the comparator CMP is connected with an output terminal of the CR integrator circuit by the resister R1 and the capacitor C2, while a non-inverted input terminal of the comparator CMP is connected with a comparative voltage source Vref. A value of voltage of the comparative voltage source Vref is set at a potential of the inverted input terminal when an electric charge accumulated by the CR integrator circuit reaches a determined amount. Thereby, the comparator CMP compares a voltage level of an signal input at the inverted input terminal with the comparative voltage source Vref of the non-inverted input terminal, and a compared result can be output as a digital signal to the output terminal.

A predetermined output signal (for example, H level) is issued from the comparator CMP by composing the-ignition detecting unit 22 as above mentioned, when the electric charge accumulated by the CR integrator circuit exceeds the predetermined amount. Thereby, the ignition information is output to the ignition control unit 24.

The ignition stop unit 23 comprises mainly the microcomputer and a predetermined control program. For example, it is exerted by ECU via the ignition control unit 24 as mentioned later. The determined input port of ECU is connected with the ignition information output of the ignition detecting unit 22, and an output information based on the ignition information is output to the ignition control unit 24. Specifically, if the ignition control unit 23 is input with the ignition information output from the ignition detecting unit 22, the ignition control unit 23 issues the ignition stop information. The ignition stop information implies an output indicating to the fire control unit 24 a control of re-conducting to the primary coil of the ignition coil 12.

The ignition stop unit 24 comprises mainly the microcomputer and a predetermined control program, for example, ECU. The ignition stop unit 24 is input with an output information from the ignition stop unit 23, while the output port of ECU exerting the ignition control unit 24 is connected with the other end of the primary coil composing the ignition coil 12. Thereby, the ignition stop information is input from the ignition stop unit 23, while the primary coil of the ignition coil 12 is connected with the minus terminal of the battery BATT via the switching element.

The ignition control unit 24 composes as mentioned above. And ON/OFF of the primary coil of the ignition coil 12 by the switching element is controlled, thereby it enables generating the spark discharge voltage in the secondary coil of the ignition coil 12 so that the spark discharge voltage is impressed between the electrodes of the spark plug 10 to generate the spark discharge.

By the ignition stop information input from the ignition stop unit 23, the ignition control unit 24 receives the order of the control of re-conducting at the primary coil of the ignition coil 12. Thereby, the inductive current is generated in the reversal direction to the already generating inductive current in the secondary coil of the ignition coil 12 so that it is possible to restrain occurrence of the spark discharge voltage by the ignition coil. Thus, it is possible to stop the spark discharge by the ignition coil 12.

Figure 3A:
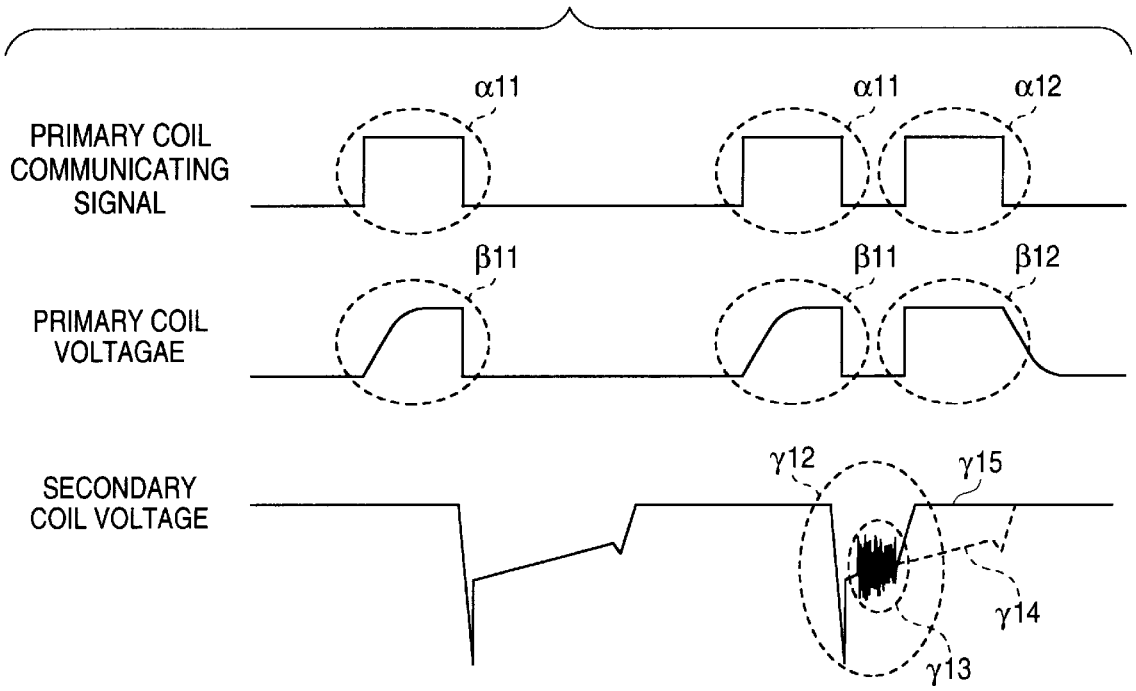
FIG. 3A and FIG. 3B are time charts showing the respective signals and waveforms of voltage by the ignition apparatus for internal combustion engine relating to the embodiment.

Actuation of the above mentioned ignition apparatus for an internal combustion engine will be explained by referring to. FIG. 3. As shown in FIG. 3A, if the primary coil communicating signal is given to the switching element (α11 shown in FIG. 3A) continuously for a fixed time by the ignition control unit 24 through the ECU control, a primary coil voltage (β11 FIG. 3A) is generated in the primary coil of the ignition coil 12. If the electric conduction of the primary coal is cut off, the secondary coil voltage is generated in the secondary coil of the ignition coil 12 (γ11 shown in FIG. 3A). And, the spark discharge voltage is impressed between the electrodes of the spark plug 10. Thereby, the spark discharge voltage occurs between the electrodes of the spark plug 10.

If the air-fuel mixture in the cylinder is ignited by the spark discharge (γ12 shown in FIG. 3A), a remarkable high frequency oscillation appears by the discharged voltage (γ13 shown in FIG. 3A). Therefore, it is possible to detect components of higher frequency than a determined high frequency contained in the discharged voltage immediately after ignition by the waveform detecting unit 20. Therefore, the ignition information is output from the ignition detecting unit 22 to the ignition stop unit 23. Thereby, as the ignition stop information is output from the ignition stop unit 23 to the ignition control unit 24, and the ignition stop is controlled by the ignition control unit 24. Therefore, the spark discharge of the spark plug is stopped.

In short the ignition control unit 24 impresses a re-communicating signal to the primary coil of the ignition coil 12 through the ignition stop information by the ignition stop unit 23 (α12 shown in FIG. 3A) by receiving the ignition information from the ignition detecting unit 22. Thereby, the primary coil voltage again occurs (β12 shown in FIG. 3A). Accordingly, the inductive current is generated in the reversal direction to the already generating inductive current in the secondary coil of the ignition coil 12 so that it is possible to restrain occurrence of the spark discharge voltage by the ignition coil 12 (γ14 shown in FIG. 3A). And, it is possible to stop the spark discharge of the spark plug 10 (γ15 shown in FIG. 3A).

Figure 3B:
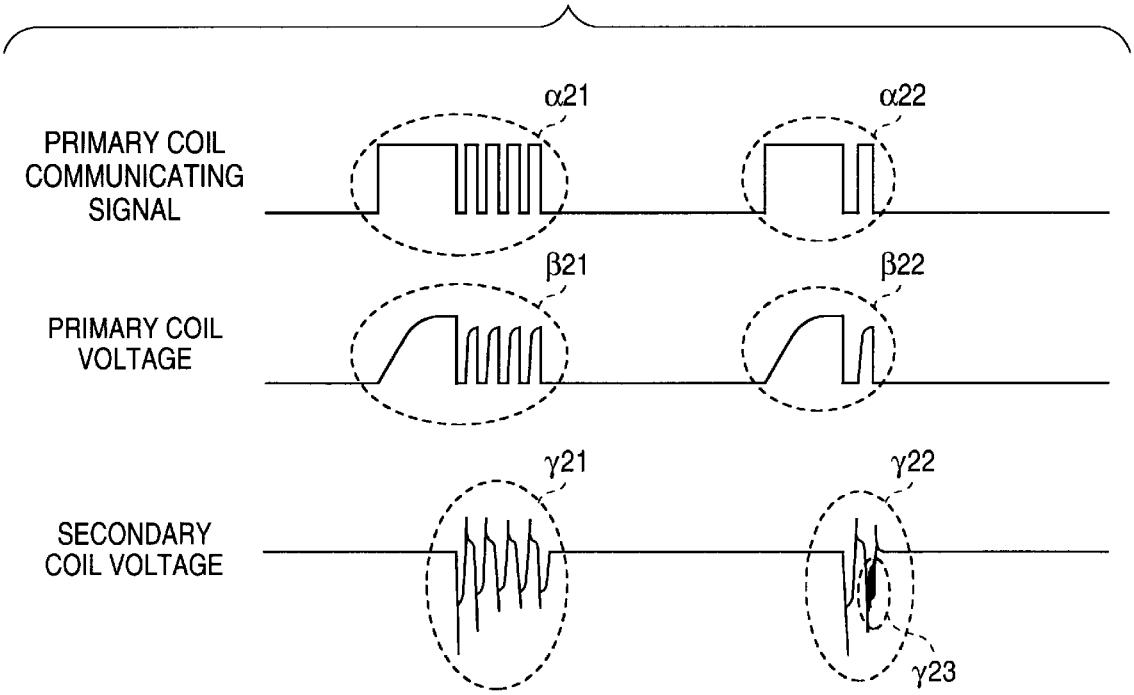

Another control method by the ignition control unit 24 is shown in FIG. 3B. In FIG. 3B, the ignition control unit 24 performs a control for repeatedly plural times generating the spark discharge voltage, and the ignition stop unit 23 performs to interrupt the control of repeating generation by the ignition control unit 24.

As also seen in FIG. 3B, if the primary coil communicating signals are given to the switching element by repeating plural times (for example, 5 times) (α21 shown in FIG. 3), the primary coil voltage occurs (β21 shown in FIG. 3B) in the primary coil in response to the repetition and the secondary coil voltage occurs in the secondary coil (γ21 shown in FIG. 3B). Thereby, the spark discharge voltage is impressed between the electrodes of the spark plug 10 to generate the spark discharge.

If the ignition is made by the spark discharge during repeating to supply the spark discharge voltage, a remarkable high frequency oscillation appear by the discharged voltage (γ23 shown in FIG. 3B). Therefore, it is possible to detect components of higher frequency than a determined high frequency contained in the discharged voltage immediately after ignition by the waveform detecting unit 20. Therefore, the ignition information is output from the ignition detecting unit 22 to the ignition stop unit 23. Thereby, as the ignition stop information is output from the ignition stop unit 23 to the ignition control unit 24, the ignition stop is controlled by the ignition control unit 24, and the spark discharge of the spark plug is stopped.

In receiving the ignition information from the ignition detecting unit 22 before reaching the predetermined repeating number, the impressing of the repeated communication signal by the ignition control unit 24 is interrupted (α22 shown in FIG. 3B) through the ignition stop information by the ignition stop unit 23. Thereby, the spark discharge voltage is restrained from generation by the ignition coil 12, since the primary coil voltage is restrained from generation (β22 shown in FIG. 3B). And, the spark discharge of the spark plug 110 can be stopped.

In such control, the repeated communication control of the primary coil of the ignition coil 12 by the ignition control unit 24 is interrupted by the ignition stop unit 23 through the ignition information output from the ignition detecting unit 22. Thereby, since the control for repeatedly generating the spark discharge voltage by the ignition coil 12 is interrupted, the spark discharge by the ignition coil 12 can be stopped.

Further, the ignition control unit 24 is interrupted by the ignition stop unit 23, whereby the stoppage of supply of the spark discharge voltage by the ignition stop unit 23 can be easily embodied like software. Accordingly, the ignition stop unit 23 is easily realized by the software control without an additional hardware.

Herein, explanation will be made to results of a computer simulation on the basis of FIG. 4 with respect to the amount of gap increasing of the spark plug 10 at the driving of the stratified combustion in two cases. A first case is that the spark discharge voltage is impressed to the spark plug by using of the ignition apparatus for internal combustion engine of the present embodiment. A second case is that the spark discharge voltage is impressed to the spark plug by using of the ignition apparatus for internal combustion engine of the related art.

The internal combustion engine carried out with the computer simulation is an in-line four-cylinder four-valve DOHC in-cylinder injecting engine having a replacement of 1.8L. The driving condition of the internal combustion engine is set to be 3000 rotation per second, 40N·m and a spark discharge voltage detecting unit F=27.0 (driving of the stratified combustion).

Figure 4:
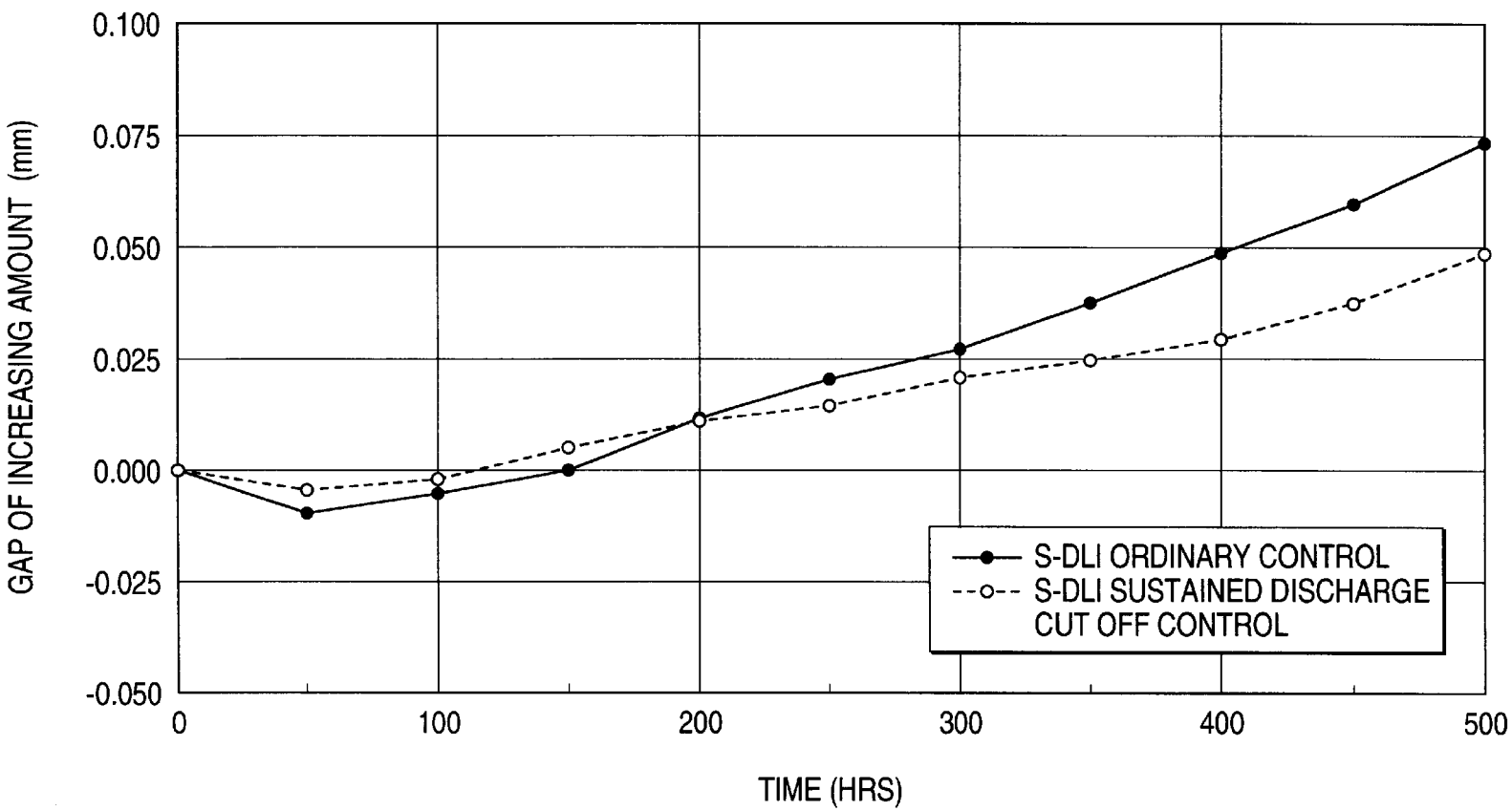
FIG. 4 is characteristic drawings showing the results of the computer simulation with respect to the gap of the increasing amount of the spark plug at driving of the stratified combustion.

The characteristic line of white circle plots in FIG. 4 shows the first case (S-DLI sustained discharge cut-off control), and the characteristic line of black circle plots shows the second case (S-DLI ordinary control).

As shown in FIG. 4, it is seen that the characteristic line (white circle plots) by the ignition apparatus for the ignition apparatus for internal combustion of this embodiment decreases the amount of increasing gap as increasing the using time (has) of the spark plug than the characteristic line (black circle plots) by the ignition apparatus for the existing ignition apparatus for internal combustion. For example, when the using time reaches 500 hours, the gap increasing amount is around 0.048 mm in the present embodiment, while it is around 0.073 mm in the related art. The gap increasing amount of the present embodiment is less than that of the related art.

That is, in case the spark discharge voltage is impressed on the spark plug by the conventional ignition apparatus for the ignition apparatus for internal combustion, in order that the stratified combustion is available in response to any driving conditions, the spark discharge time is set to be somewhat longer, and the inductive current necessary for the spark discharge is supplied to the spark plug for a determined time, irrespective of driving conditions. Therefore, the electrode wear of the spark plug accelerates by the excessive spark energy, and consequently, the gap increasing amount is heightened. Namely, according to the existing ignition apparatus for the ignition apparatus for internal combustion, it is shown that the spark plug is resulted in shortening the life cycle.

On the other hand, if the spark discharge voltage is impressed to the spark plug 10 by the ignition apparatus for internal combustion engine of this embodiment, during the period while the spark discharge is detected by the waveform detecting unit 20 and the ignition coil 12 supplies by the ignition detecting unit 22, the ignition in each cylinder is detected on the basis of the detecting voltage by the waveform detecting unit 20. When the ignition detecting unit 22 detects the ignition by the ignition control unit 24, during the period while the spark discharge voltage having detected the ignition is supplied, the supply of the spark discharge voltage is stopped. Thereby, since the supply of the spark discharge voltage is stopped after having detecting the ignition, it is possible to prevent the supply of the excessive spark energy to the spark plug after ignition, and as a result, the gap increasing amount appears as decrease. In short, according to the ignition apparatus for internal combustion of this embodiment, it is shown that this has an effect of increasing the life cycle of the spark plug 10 without degrading the ignition capacity of the internal combustion engine.

Further explanation will be made to another embodiment relating to the ignition apparatus for internal combustion engine of the invention, referring to FIG. 5.

Figure 5:
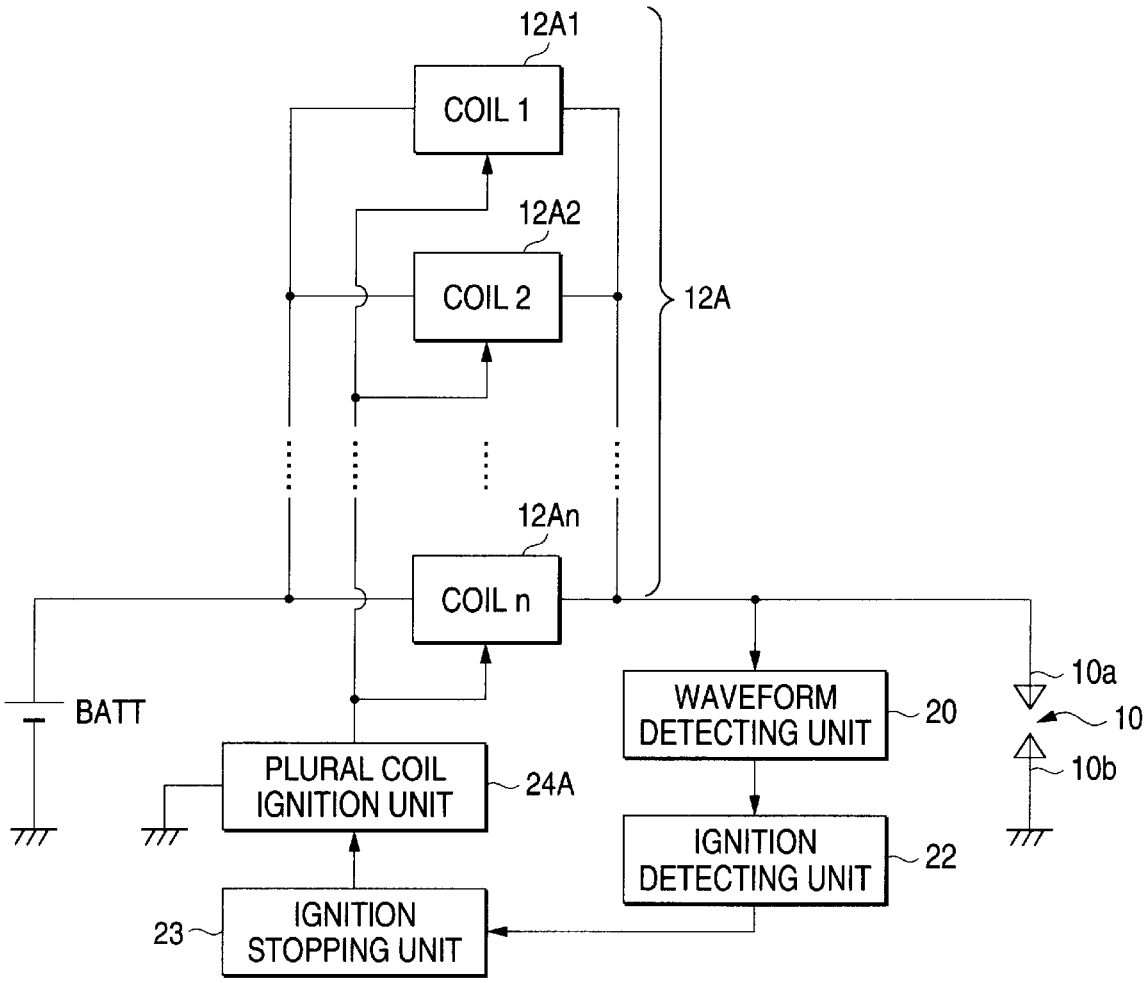
FIG. 5 is a composition drawing schematically showing the ignition apparatus for internal combustion engine relating to the other embodiment.

The ignition apparatus for an internal combustion shown in FIG. 5 comprises the ignition coil 12A which includes plural coils 12A1, 12A2 . . . 12An (called as coils "12A1 to 12An" hereafter), and to the coils 12A1 to 12An, the plural ignition control unit 24A for supplying the spark discharge voltage are provided in succession and separately. Substantially the same composing parts as those of the ignition apparatus for the internal combustion engine relating to the embodiment shown in FIG. 1 are given the same reference numerals to omit explanation therefor.

The ignition coil 12A comprises the plural (for example, four pieces) coils 12A1 to 12An, and each of the coils 12A1 to 12An is connected in parallel. Actually, the coils 12A1 to 12An are connected at one end of the respective primary coils with plus terminals of a battery BATT and at the other end of the respective primary coils with minus terminals of the battery BATT through the switching element composing the plural coil ignition control 24A. On the other hand, the coils 12A1 to 12An are connected at one end of the respective secondary coils with the center electrode 10*a* of the spark plug 10 and at the other end of the respective secondary coils with the ground, electrode 10*b* through the earth.

The total amount of the spark energy obtained by the ignition coil 12A comprising the coils 12A1 to 12An is equivalent to the total amount of the spark energy obtained by the ignition coil 12 composing the ignition apparatus for internal combustion engine shown in FIG. 1. Namely, the primary coil and the secondary coil of the ignition coil 12 are divided into plural pieces so as to correspond to the coils 12A1 to 12An.

The plural coil ignition control unit 24A comprises the microcomputer and the determined program as almost the same as the ignition control 24 of the above-mentioned embodiment. But, the plural coil ignition control unit 24A is different from the ignition control unit 24 in that an output port is connected with the plural coils 12A1 to 12An.

Practically, the determined port of the plural coil ignition control unit 24A is connected with the output of the ignition stop information by the ignition stop unit 23, and the respective primary coils of the coils 12A1 to 12An are connected at the other ends of the primary coils with the respective output ports of the plural coil ignition control unit 24A. Thereby, the coils 12A1 to 12An are connected at the respective primary coils with the respective minus terminals of the battery BATT through the switching element.

Figure 6:
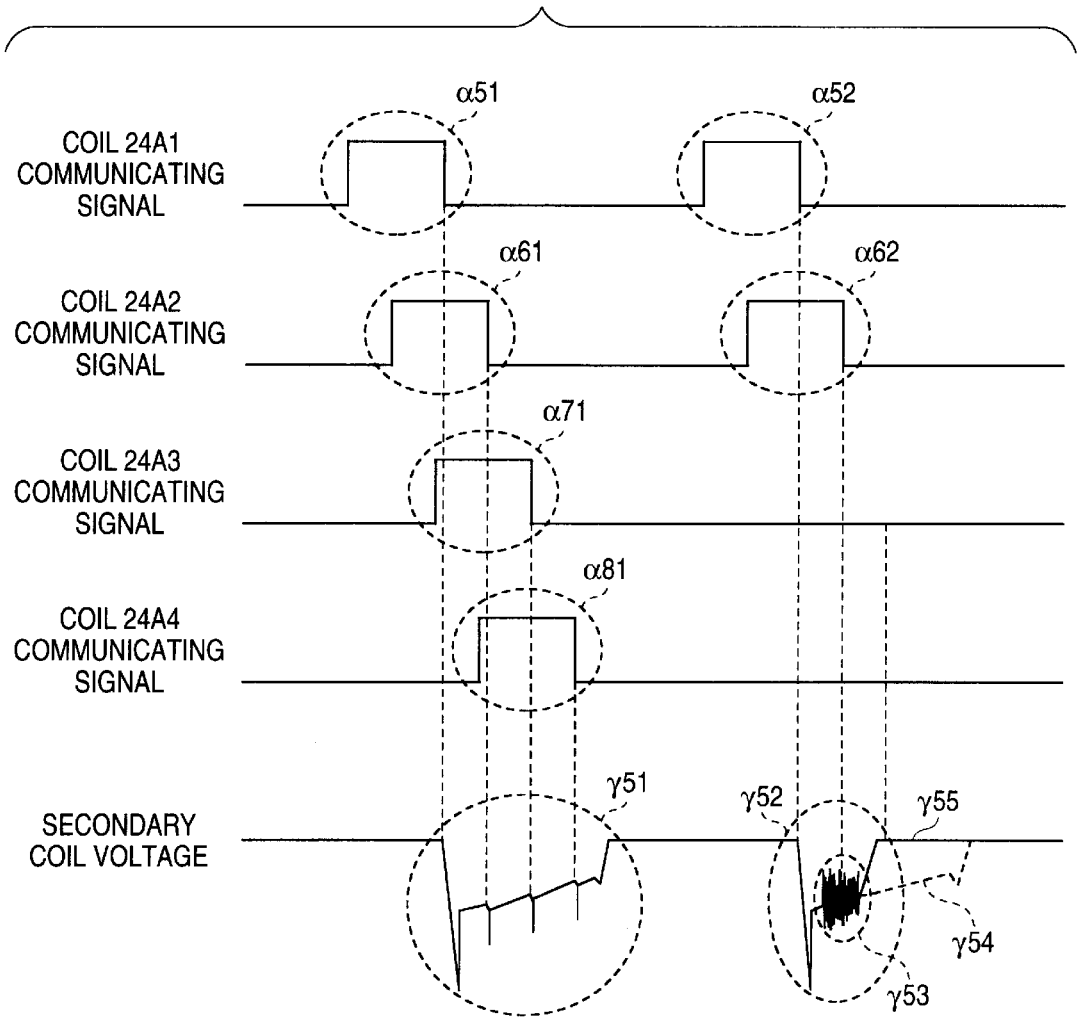
FIG. 6 is time chart showing the respective signals and waveforms of voltage by the ignition apparatus for internal combustion engine relating to the other embodiment.

The plural coil ignition control 24A is comprised as mentioned above for controlling ON/OFF of the respective primary coils of the coils 12A1 to 12An (in FIG. 6, four pieces) by the switching element shown in FIG. 6 ($\alpha$51, $\alpha$61, $\alpha$71, $\alpha$81 shown in FIG. 6). Thereby, it is possible to generate in successor the spark discharge voltage to the respective secondary coils of the four coils. Therefore, between-the electrodes of the spark plug 10, the spark discharge voltage is impressed in succession by the coils 12A1 to 12An, and the spark discharge occurs successively.

When the air-fuel mixture in the cylinder is fired by the spark discharge ($\gamma$52 in the same), since remarkable high frequency oscillation occur in the discharged voltage ($\gamma$53), it is possible to detect components of higher frequency than a determined high frequency contained in the discharged voltage immediately after ignition by the waveform detecting unit 20. Therefore, the ignition information is output from the ignition detecting unit 22 to the ignition stop unit 23. Thereby, as the ignition stop information is output from the ignition stop unit 23 to the plural coil ignition control unit 24A, the ignition stop is controlled by the ignition control unit 24, and the spark discharge of the spark plug is stopped.

In short, by receiving the ignition information from the ignition detecting unit 22, the plural ignition control unit 24A interrupts the impressing of the communication signals to the coils 12A1 to 12A4 through the ignition stop information by the ignition stop unit 23. In FIG. 6, the communicating signals are impressed to the coils 12A1 and 12A2 (α52, α62), and are not impressed to the coils 12A3 and 12A4. Thereby, the secondary coil voltage by the coils 12A3 and 12A4 is restrained from occurrence (γ54), and the spark discharge of the spark plug 10 can be stopped (γ55).

According this embodiment, the ignition coil 12A comprises the plural coils 12A1 to 12An, and the plural coil ignition control 24A is provided for supplying the spark discharge voltage in succession and separately to the plural coils 12A1 to 12An, and the stoppage of supply of the spark discharge voltage by the ignition stop unit 23 is performed by interrupting the successive supply of the spark discharge voltage by the plural coil ignition control 24A. Thereby, the plural coil ignition control unit 24A is interrupted by the ignition stop unit 23, whereby the stoppage of supply of the spark discharge voltage by the ignition stop unit 23 can be easily embodied like software. Accordingly, the ignition stop unit 23 is easily realized by the software control without addition of hardware.

Incidentally, the ECU in the above mentioned respective embodiments may be added with the function of the driving condition discriminating means for discriminating the driving condition of the internal combustion engine. Thereby, when the driving condition of the internal combustion engine is discriminated as, for example, lean or layer air-intake, the control is carried out through the waveform detecting unit 20, the ignition detecting unit 22 and the ignition control unit. Therefore, under the driving condition of lean or layer air-intake where the supply time of the spark discharge voltage by the ignition coil is longer than that of the uniform premixed air-fuel mixture combustion, it is possible to prevent the supply of the excessive spark energy to the spark plug 10 after ignition. Accordingly, this has an effect of increasing the life cycle of the spark plug 10 in response to the driving condition of the internal combustion engine without degrading the ignition capacity of the internal combustion engine.

Further, in "the control is performed for generating by repeating plural times the spark discharge voltage to the ignition coil 12 by use of the ignition control unit 24" or "the ignition detection 12A comprises the plural coils 12A1 to 12An, and the plural coil ignition control 24A is provided for supplying the spark discharge voltage in succession and separately to the plural coils 12A1 to 12An", it is sufficient that the stoppage of supply of the spark discharge voltage by the ignition stop unit 23 is performed together with the re-supply of the primary current to the primary coil of the ignition control 12.

Thereby, in "the control is performed for generating by repeating plural times the spark discharge voltage to the ignition coil 12 by use of the ignition control unit 24", although being during the period of repeating to supply the spark discharge voltage by the ignition control unit 24, or in "the ignition detection 12A comprises the plural coils 12A1 to 12An, and the plural coil ignition control 24A is provided for supplying the spark discharge voltage in succession and separately to the plural coils 12A1 to 12An", although being during the period of supplying the spark discharge voltage by the coils 12A1 to 12An, the inductive current is caused in the reversal direction to the already caused inductive current in the ignition coil 12 or in the secondary coil of the coils 12A1 to 12An, so that it is possible to restrain occurrence of the spark discharge voltage by the ignition coils 12, 12A.

In a method for controlling ignition in an internal combustion engine according to the present invention, the current supplied to a primary coil of an ignition coil for generating and stopping a spark discharge voltage in a secondary coil of the ignition coil is controlled by, for example, a ignition control unit according to an embodiment described above. The spark discharge voltage is supplied from the ignition coil to an spark plug, and a supplied spark discharge voltage is detected. Ignition is then detected in at least one cylinder of the combustion engine in accordance with the detected spark discharge voltage during a period when the ignition coil supplies the spark discharge voltage, and the supply of the spark discharge voltage is stopped based on the detected ignition.

Further, the method may include detecting the ignition based on a predetermined high frequency component included in the spark discharge voltage. In addition, the supply of the spark discharge voltage may be stopped by providing the current to the primary coil.

In the present invention according to a first aspect of the present invention, for the period when the spark discharge voltage is detected by the spark discharge voltage detecting unit and when the ignition coil supplies the spark discharge voltage by the ignition detecting unit, the ignition of each cylinder is detected in accordance with the detecting voltage by the spark discharge voltage detecting unit. When the ignition detecting unit detects the ignition by the second ignition control unit, the supply of the spark discharge voltage is stopped for the discharging period when the spark discharge voltage having detected the ignition is supplied, thereby the ignition is detected and the supply of the spark energy is stopped, so that it is possible to prevent the supply of the excessive spark energy to the spark plug after ignition. Accordingly, this has an effect of improving the life cycle of the spark plug without degrading the ignition capacity of the internal combustion engine.

In second aspect of the invention, when the driving condition of the internal combustion engine is discriminated as, for example, a lean or layer air-intake condition by means of the driving condition discriminating means for discriminating driving conditions of the internal combustion engine, the control is carried out through the spark discharge voltage detecting unit, the ignition detecting unit and the second ignition control unit. Thereby, under the driving condition of lean or layer air-intake where the supply time of the spark discharge voltage by the ignition coil is longer than that of the uniform premixed air-fuel mixture combustion, it is possible to prevent the supply of the excessive spark energy to the spark plug after ignition. Accordingly, this has an effect enabling to improve the life cycle of the spark plug without spoiling the ignition capacity of the internal combustion engine in response to the driving conditions of the internal combustion engine.

In a third aspect of the invention, the detection of ignition by the ignition detecting unit is performed by detecting predetermined high frequency components included in the spark discharge voltage. Thereby, it is possible to detect a high frequency oscillation of the discharged voltage caused by disturbing a discharged spark of the spark plug through the good combustion after ignition, so that the ignition detection can be easily done. Accordingly, this has an effect enabling to comparatively easily improve the life cycle of the spark plug without spoiling the ignition capacity of the internal combustion engine.

In a fourth aspect of the present invention, the stoppage of a supply of the spark discharge voltage by the second ignition control unit is performed by re-supplying a primary current to the primary coil of the ignition coil. Thereby, in the secondary coil of the ignition coil, an inductive current is caused in a reversal direction to the already caused inductive current, so that it is possible to restrain occurrence of the spark discharge voltage by the ignition coil. Accordingly, it is possible to comparatively easily stop the supply of the spark discharge voltage by the ignition coils.

In a fifth aspect of the present invention, the control is carried out for generating a plurality of times of repeating the spark discharge voltage to the ignition coil by means of the first ignition control unit, and the control for the repeating generations by the first ignition control unit is interrupted by means of the second ignition control unit. Thereby, the interrupting control by the second ignition control unit as performed for the first ignition control unit, so that it is possible to easily embody the stoppage of the spark discharge voltage by the second ignition control unit. Accordingly, this has an effect enabling to easily realize the second ignition control unit with the software without adding the hardware.

In a sixth aspect, the ignition coil comprises plural coils which are provided with the ignition control unit of a plurality of coils supplying in succession and separately the spark discharge voltage in substitution for the first ignition control unit, and the stoppage of supply of the spark discharge voltage by the second ignition control unit is performed by the interruption of successive supply of the spark discharge voltage by the ignition control unit of the plural coils. Thereby, the interrupting control is performed by the second ignition control for the ignition control unit of the plural coils, so that it is possible to easily embody the stoppage of the spark discharge voltage by the second ignition control unit. Accordingly, this has an effect enabling to easily realize the second ignition control unit with the software without adding the hardware.

In a seventh aspect, in the ignition apparatus for internal combust on engine, the stoppage of supply of the spark discharge voltage by the second ignition control unit is performed together with re-supply of the primary current to the primary coil of the ignition coil. Thereby, although being during the period of repeating supply of the spark discharge voltage by the first ignition control unit in the first ignition control unit set forth in the fifth aspect, or during the period of supplying the spark discharge voltage by the coil in the plural coil ignition control unit set forth in the sixth aspect, in the ignition coil or the secondary coil of the coil, an inductive current is caused in a reversal direction to the already caused inductive current, so that it is possible to restrain occurrence of the spark discharge voltage by the ignition coil. Accordingly, inspire of the period of supplying the spark discharge voltage, the supply can be stopped, so that it is possible to stop the supply of the spark discharge voltage by the ignition coil at the higher precision.

In an eighth aspect of the present invention, the spark discharge voltage detecting unit is equipped with a coupling capacitor for a primary circuit of the ignition coil or a secondary coil circuit of the ignition coil, and by means of a comparatively simple circuit composition of connecting a capacitor in series to the primary coil circuit or the secondary coil circuit, while removing direct current components, it is possible to take out an objective predetermined high frequency components. Accordingly, this has an effect enabling to detect the waveforms of voltage of the spark plug by means of the comparatively simple circuit.

What is claimed is:

1. An ignition apparatus for an internal combustion engine comprising;

at least one spark plug operable to ignite a fuel mixture in at least one cylinder of an internal combustion engine;

an ignition coil including at least one primary coil and at least one secondary coil operable to generate a spark discharge voltage to be supplied to the at least one spark plug;

a spark discharge voltage detecting unit operable to detect the spark discharge voltage;

an ignition detecting unit operable to detect an ignition in the at least one cylinder during a period when the ignition coil supplies the spark discharge voltage;

a first ignition control unit operable to control a current supplied to the at least one primary coil for generating the spark discharge voltage in the at least one secondary coil; and a second ignition control unit operable to control the current supplied to the at least one primary coil to stop the supply of the spark discharge voltage in the at least one secondary coil, wherein said second ignition control unit stops the supply of the spark discharge voltage in the at least one secondary coil based on the detected ignition during the period when the ignition coil supplies the spark discharge voltage.

2. The ignition apparatus for an internal combustion engine according to claim 1, further including:

a driving condition discriminating unit operable to determine operating conditions of the internal combustion engine and supply the determined operating conditions to a first ignition control unit, a second ignition, control unit, the spark discharge voltage detecting unit, and the ignition detecting unit.

3. The ignition apparatus for an internal combustion engine according to claim 2, wherein the determined operating conditions include a fuel to air mixture in the cylinder.

4. The ignition apparatus for an internal combustion engine according to claim 1, wherein the ignition detecting unit detects the ignition in the at least one cylinder based on a predetermined high frequency component included in the spark discharge voltage.

5. The ignition apparatus for an internal combustion engine according to claim 1, wherein the supply of the spark discharge voltage is stopped by providing the current to the at least one primary coil.

6. The ignition apparatus for internal combustion engine according to claim 1, wherein the supply and interruption of the supply of the current to the at least one primary coil by the first and second ignition control units is repeatedly performed.

7. The ignition apparatus for an internal combustion engine according to claim 1, wherein the spark discharge voltage detecting unit comprises a coupling capacitor operable with the at least one primary coil and the at least one secondary coil.

8. A method for controlling ignition in an internal combustion engine comprising:

controlling a current supplied to a primary coil of an ignition coil for generating and stopping a spark discharge voltage in a secondary coil of the ignition coil;

supplying the spark discharge voltage from the ignition coil to spark plug;

detecting the supplied spark discharge voltage;

detecting an ignition in at least one cylinder of the combustion engine in accordance with the detected spark discharge voltage during a period when the ignition coil supplies the spark discharge voltage; and stopping the supply of the spark discharge voltage based on the detected ignition.

9. A method for controlling ignition in an internal combustion engine according to claim 8, wherein the ignition is detected based on a predetermined high frequency component included in the spark discharge voltage.

10. A method for controlling ignition in an internal combustion engine according to claim 8, wherein the supply of the spark discharge voltage is stopped by providing the current to the primary coil.

* * * * *